US005119732A

United States Patent [19]

Lisy

[11] Patent Number: 5,119,732

[45] Date of Patent: Jun. 9, 1992

[54] PORTABLE GANTRY ROBOT

[75] Inventor: Donald J. Lisy, Downers Grove, Ill.

[73] Assignee: R.R. Donnelley & Sons Company, Chicago, Ill.

[21] Appl. No.: 643,036

[22] Filed: Jan. 18, 1991

[51] Int. Cl.[5] ..... B65G 65/00

[52] U.S. Cl. ..... 104/48; 104/88; 104/89; 104/91; 104/98; 104/102

[58] Field of Search ..... 104/48, 88, 89, 90, 104/96, 98, 102, 106, 111, 130, 131, 137; 414/279, 253, 264

[56] References Cited

U.S. PATENT DOCUMENTS

| | | | |
|---|---|---|---|
| 1,220,797 | 3/1917 | Tanner | 104/48 |
| 1,331,208 | 2/1920 | O'Brien | 104/48 |
| 3,021,795 | 2/1962 | Hayba et al. | 104/48 |
| 3,132,598 | 5/1964 | Pearson | 104/98 |
| 3,442,223 | 5/1969 | Graham | 104/48 |
| 3,650,215 | 3/1972 | Werthessen | 104/98 |
| 3,779,403 | 12/1973 | Young | 414/279 |
| 3,913,758 | 10/1975 | Faircloth et al. | 104/48 |
| 3.922,381 | 1/1975 | Horni | 104/48 |
| 3,973,685 | 8/1976 | Loomer | 414/273 |
| 3,978,995 | 9/1976 | Zollinger et al. | 901/1 |
| 4,090,620 | 5/1978 | Johansson et al. | 104/48 |
| 4,190,013 | 2/1980 | Otis et al. | 206/387 |
| 4,286,911 | 9/1981 | Benjamin | 414/273 |
| 4,309,758 | 1/1982 | Halsall et al. | 29/568 |
| 4,369,563 | 1/1983 | Williamson | 29/568 |
| 4,383,789 | 5/1983 | Takamatsu | 414/277 |
| 4,395,180 | 7/1983 | Magnotte | 104/98 |
| 4,523,887 | 6/1985 | Reiff | 414/464 |
| 4,566,032 | 1/1986 | Hirooka et al. | 358/103 |
| 4,623,032 | 11/1986 | Kemmer | 180/169 |
| 4,643,628 | 2/1987 | Pini | 414/279 |
| 4,669,390 | 6/1987 | Bisiach | 104/248 |
| 4,697,239 | 9/1987 | Sicard et al. | 364/468 |
| 4,700,301 | 10/1987 | Dyke | 364/424.02 |
| 4,702,661 | 10/1987 | Bisiach | 414/460 |
| 4,752,176 | 6/1988 | Linder | 414/278 |
| 4,773,807 | 9/1988 | Kroll et al. | 252/184 |
| 4,796,198 | 1/1989 | Boultinghouse et al. | 364/513 |
| 4,811,228 | 3/1989 | Hyyppa | 364/424.02 |

FOREIGN PATENT DOCUMENTS

| | | | |
|---|---|---|---|
| 2706259 | 9/1977 | Fed. Rep. of Germany | 104/48 |
| 3423916 | 1/1986 | Fed. Rep. of Germany | 104/96 |
| 0453962 | 6/1913 | France | 104/98 |
| 0041364 | 3/1977 | Japan | 104/48 |

OTHER PUBLICATIONS

C & D Machine & Engineering Brochure (no date).
Automation Equipment Company Brochure (no date).
Cybermotion Brochure (no date).
Mentor AGVS, Inc. Brochure (no date).
MRI Brochure (no date).
*Design News* Article—"Machine Vision System Follows Landmarks"—Jul. 23, 1990, (pp. 120–121).
*Managing Automation* Article—"Is Off-Wire AGV Guidance Alive or Dead"—May 1990, (pp. 38–40).

*Primary Examiner*—Robert J. Oberleitner
*Assistant Examiner*—Mark T. Le
*Attorney, Agent, or Firm*—Wood, Phillips, Van Santèn, Hoffman & Ertel

[57] ABSTRACT

In order to reduce operating costs while enhancing the overall operating efficiency of an industrial plant, a method for automating a plant or warehouse using portable gantry robots is provided. Work stations for the robots are organized along rows in various parts of the plant where work is present. An overhead rail system is provided over the work stations wherein at least some overhead rail system have sections of displaceable rails. A transporter is provided for transporting the portable robots between rail systems or locations within a rail system. The transporters have a section of transfer rails which are identical in size to the displaceable rail section. A displaceable rail section is displaced following which the transfer rail section is locked into plance. The transfer rail section may also be aligned at one end of an overhead rail system. The robots are then added or removed from the overhead rail system while the transfer rail section is aligned with the overhead rail system.

18 Claims, 6 Drawing Sheets

PORTABLE GANTRY ROBOT

FIELD OF THE INVENTION

This invention relates to automation systems and more particularly to the transportation of portable gantry robots.

BACKGROUND OF THE INVENTION

Printing plants, as well as other industrial plants, could be operated more efficiently by using robotic units to carry out various tasks, such as, palletizing and depalletizing materials. However, many plants do not have enough palletizing or depalletizing work in any one location to justify the expense of installing a robot dedicated to that particular location. However, despite this fact these same plants might have sufficient work dispersed around the plant to cumulatively justify the costs for one or more robots.

Generally, the robotic units used for palletizing or depalletizing work require a very stable base on which to operate which precludes transporting the same robot around a plant between various locations. However, advances in the development of image technology have made it possible to design lightweight, portable robots for palletizing and depalletizing work.

The focus of current robotics research in this area involves the integration of fixed overhead vision systems with robotic controls to provide object based motion planning. This technology permits fast, precise robot control while utilizing lightweight robot construction. Consequently, massive, stiff, super-accurate mechanical components would no longer be a requirement to achieve precision manipulations by the robotic unit. These advancements in robot technology will thus enable the use of overhead crane rails or runways, which could be of lightweight construction, for suspension of a robotic unit thereon.

The foregoing areas of robot technology are currently under development at many research facilities including the Center For Automation and Manufacturing Science, Institute for Manufacturing and Automation, at Stanford University.

It is also currently possible to use the same robotic unit in parallel working modes. For example, a minor programming adjustment enables the same robotic unit that had been implementing operational sequences which result in the performance of palletizing work to perform depalletizing work. Therefore, the technology exists for using the same robotic unit for palletizing work in one part of a printing plant and then transporting that unit to another area of the plant for depalletizing work in order to make more economical use of the robot. A robot working in an area experiencing a lull in operations, can thus be moved to another area needing a robot. Conversely, an area which has more work than the current supply of robots in that area can handle, could be provided with more robots.

It would be advantageous to arrange the work areas having materials for palletizing or depalletizing in a row with continuous crane track or rails over the row of work areas for supporting a robotic unit. The robotic units could then be moved along the rail to the particular work area having work for the unit.

When there is palletizing or depalletizing work for a robotic unit in an area between other working robots, it would be advantageous to be able to insert a robot onto the rail line to reach its work area without disturbing the other robots, rather than attaching all the robots sequentially over the work areas.

There is also a need to be able to move the robots on and off separate rail systems. The work areas for the robots would likely be dispersed in separate areas of the plant where the materials to be palletized or depalletized are located. Movement of the robots between these areas entails movement between non-contiguous overhead rail systems. Furthermore, some work areas may have extended down times. It is therefore highly advantageous to be able to move the robots between overhead rail work locations, and maintenance, repair or storage areas.

There has long been a need to provide a system for automating a printing plant which incorporates the use of portable robotic units which can be transported between non-contiguous rail lines and inserted into a particular location on a rail line without disturbing neighboring working robots.

There are many types of plants which would benefit from using portable robots which could be programmed to perform many different types of work, other than the palletizing/depalletizing tasks referred to herein.

SUMMARY OF THE INVENTION

An object of the present invention is to provide a method for automating an industrial plant by using portable robots for such work as palletizing and depalletizing materials.

Work stations for the robots are preferably organized along rows in various parts of the plant where there is work to be done by the robot. A plurality of overhead rail systems may then be suspended over separate rows of work areas and portable robots may be supported thereon while performing a work sequence. The robots can advantageously be moved between work areas along a given rail system wherein at least some of the system is provided with sections of displaceable rails.

Preferably, a transporter is used for transporting the portable robots between rail systems or locations within a rail system between other robots. The transporters advantageously contain a transfer rail section which has identical dimensions to that of the displaceable rail sections.

A displaceable rail section is displaced and a transfer rail section is then locked onto the rail system at the former location of the displaced rails. A robot is added to and removed from the overhead rail section while the transfer section is aligned with the overhead rail system. A robot that was removably attached to the transfer rail section of a transporter while the transfer rails were locked onto the fixed rail system, is moved onto the fixed rail system. A robot is removed from a rail system by being moved onto an empty transfer rail section locked onto the rail system. The transfer rails are unlocked with the robot still supported thereon and the robot can then be moved about on the transporter.

Once a robot has been moved onto the overhead rails, the automation system further includes means for moving the robot along the overhead rail system to a work area. After a robot has been transferred and the transporter has moved away, the displaced rail section is locked back into the area where it had been displaced.

In one embodiment, the sections of rails are displaceable to one side. In a second embodiment, the rails are displaceable above the rail system. In one particularly advantageous embodiment, the transporter causes the displacement of the rails.

Another objective of the present invention is to provide a robot transporter for a portable robot. The robot is carried on rails that are integral with the transporter and identical in size to the displaceable rail sections. The transporter comprises a base and means for supporting the robot by the integral transporter rails.

Another object of the present invention is to provide an automated printing plant having a press room and a bindery area. The press room comprises a plurality of press delivery stations arranged in a row. Rails are suspended above the delivery stations and have a plurality of displaceable rail sections. There is at least one portable gantry robot capable of movement along the overhead rails.

A transporter transports the robot between displaceable rail sections and has an integral transfer rail section thereon which is identical in size to the displaceable rail sections. The transporter displaces the rail section and locks in its own transfer rails, and the robot is then safely transferred on or off the rail system.

The printing plant also has a plurality of binding lines in the bindery area, having overhead rail systems of identical shape and dimensions to the rails in the press room and also capable of supporting the portable robot. The same transporter aligns with one end of the rail system to transfer the robot thereto. The transporter also moves the robot between the rail sections in the bindery and the rail system in the press room.

Other features and advantages of the invention will be apparent from the following description taken in connection with the accompanying drawings wherein:

BEST MODE FOR CARRYING OUT THE INVENTION

Figure 1:
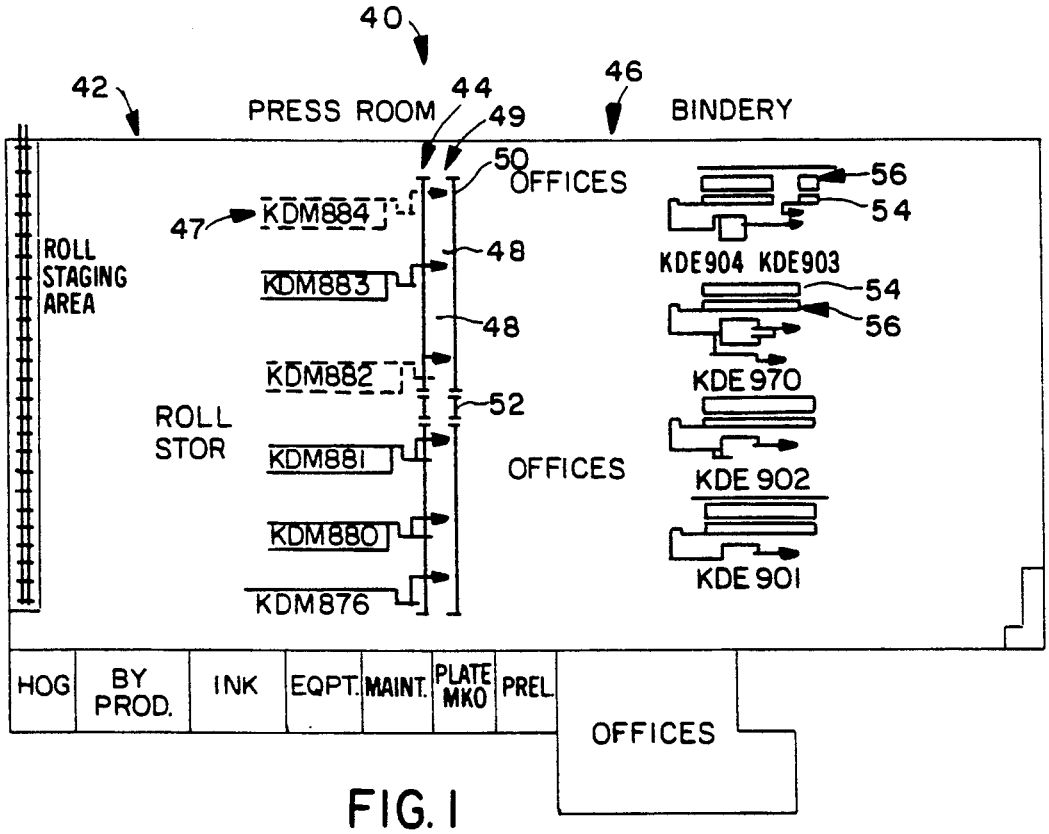
FIG. 1 is a schematic plan view of a typical printing plant having overhead rails for supporting portable gantry robots.

Referring to FIG. 1, a typical commercial printing plant layout 40 has a roll storage area 42, a press room 44 and a bindery 46. Stationary, robots massive have been used in the printing plant 40 for palletizing and depalletizing loose lifts of signatures as delivered from a stacker, or signature bundles.

Presses 47 are arranged in a row within the press room 44. Robotic work areas 48 receive deliveries from the presses 47 and are also arranged in a row 49. In accordance with the present invention, above the row of work areas 49 are a pair of overhead rails or crane runways 50. Robotic units are suspended from the overhead rails 50 to palletize the deliveries.

The robots can be used to service multiple deliveries from the work areas 48. The number of portable robotic units assigned to adjacent work areas 48 depends on various factors such as the size of the signatures, the rate of production of signatures, the number of signatures per lift, and the volume of product which could practically be loaded on a pallet. For example, a robotic unit could be assigned to three adjacent press delivery work areas 48 to maximize use of the robot's productive capacity. The three work areas do not necessarily have to belong to the same printing press 47; adjacency is the only criteria. Therefore, it can be seen that because the robotic units are movable along the overhead rail system 50, flexibility is available for maximizing efficiency.

The overhead rail system 50 has a section of rails in which the continuity is broken, as at 52, and which is displaceable from a position of alignment with the remainder of the rails 50. While the section 52 is locked into place, the rails are essentially operationally continuous for movement of a robotic unit along the entirety of the rail system 50.

The portable robotic units can be inserted onto the rails 50 at those displaceable sections 52 in order to insert the robots without disturbing neighboring working robotic units along the row 49. The robots may also be movable onto or off of either end of the rails. The number of displaceable rail sections 52 placed in the rail system 50 depends on the need for inserting or removing robotic units from that general area and can be as often as between each press 47. The rail system in the press room may, alternatively, be designed without any displaceable sections.

In the bindery area 46, there are separate overhead rail systems 54 for each binding line 56. For these rail systems 54, portable robotic units are movable onto and off of at least one end of the rails 54.

The rails 54 run parallel to the binding lines 56 and extend beyond the gathering machines therealong in one or both directions to include covering an access aisle from which the robotic units could be loaded and unloaded onto and off of the overhead rails.

The number of robotic units assigned to a given binding line and the consecutive number of boxes, hoppers, feeders and/or pockets associated with the gathering machines therealong assigned to a given robotic unit are calculated from the robotic units depalletizing mode capacity, the thickness of each signature, the speed of the binding line and the total number of depalletizing units required for a given job.

The same robotic units used to palletize loads in the press room are used to depalletize and process loads of signatures in the bindery. Dual programming for both functions are inherent in the design of the portable unit. Center to center distance between the press and bindery rails are identical.

The rail systems 50 and 54 from which the robotic units are suspended are advantageously electrically powered via bridge crane type conductor bars (not shown) for facilitating the movement of the robotic units along the rails.

A robotic transporter 58 (see FIGS. 2–4) is used to move the robotic units between the press room and bindery area. The objective in organizing the distribution of robotic units throughout the plant is to assign robotic units only to presses or binding lines which are running and to use only the number of robotic units required in a given press room or bindery at any given point in time.

Robotic units not utilized in a given press room at a given point in time are assigned to other press rooms, the bindery, a temporary storage location, or maintenance. If a robotic unit breaks down during a production run, the malfunctioning unit is replaced with another available unit and the malfunctioning unit is transported to the maintenance area.

A centralized computer is used to identify the movements of robotic units and the status of the displaceable rail sections, as well as calculate optimum distribution of the robotic units around the plant. The economically justifiable total number of robotic palletizer/depalletizer units for a given plant is dependent on a weighted average of plant production loading over a long period of time.

During periods of peak production, the remainder of the total plant product volume in excess of the total robotic unit capacity may be manually palletized and depalletized. Floor space is readily usable for manual operations since all automation (i.e. robotic units) is hung from overhead rails 50 and 54. Manual palletizing and depalletizing operations normally occur only when robotic units are not available. Therefore, there are no idle robots in the area where the manual palletizing or depalletizing work is being performed. Portable safety fences and other safety devices may be utilized to separate robot operational area from manual operational areas.

This system is not limited to the illustrated printing-/binding plant. It would be obvious to one skilled in the art to apply the same system to other types of manufacturing plants.

Figure 2:
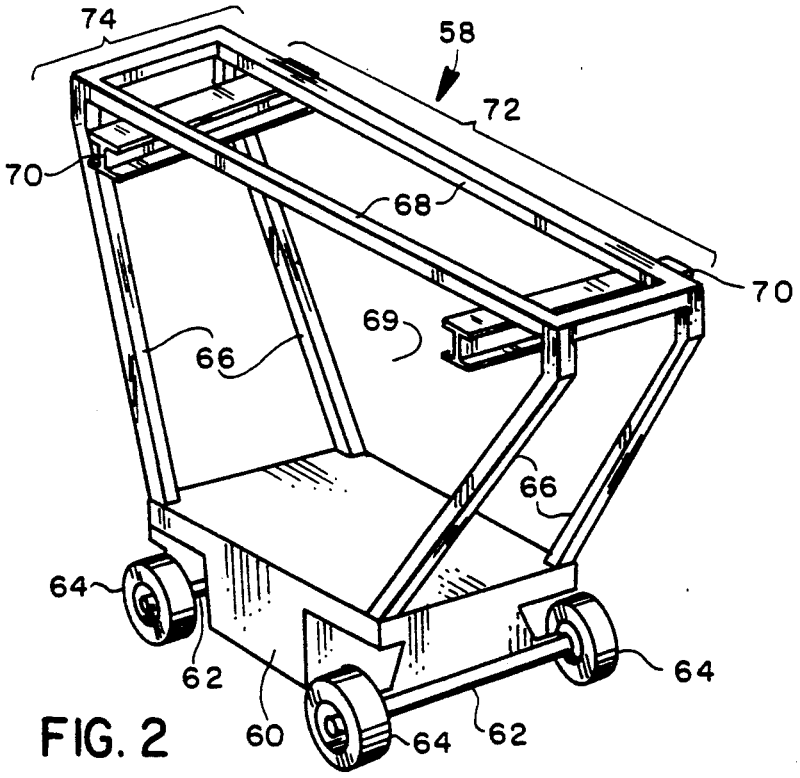
FIG. 2 is a perspective view of a robot transporter.

Referring to FIG. 2, the transporter 58 has a base 60 supported on two axles 62 and movable on wheels 64. Four elongated side members 66 extend upwardly from the base 60. Elongated transverse members 68 are connected to the top ends of the side members 66. The base, side members and transverse members define an interior space 69 of the transporter 58.

A pair of spaced sections of transfer rails 70 are supported by the transverse members 68. The cross-sectional configuration and size of the rails 70 is the same as that of the overhead rails 50 and 54 with which the transporter will be used to shuttle robotic units between. The space 72 between the rails 70 is likewise the same as the space between the rails 50 and 54 with which the transporter will be used. Finally, the length of the rails 74 is the same as the length of the displaceable rail sections 52.

It is important for the transfer rails to be of the same configuration and size as the displaceable rail sections. As will be more fully explained later, the transfer rail section that is an integral part of the transporter, is used to replace a displaceable rail section in order to insert and remove a robot.

Figure 3:
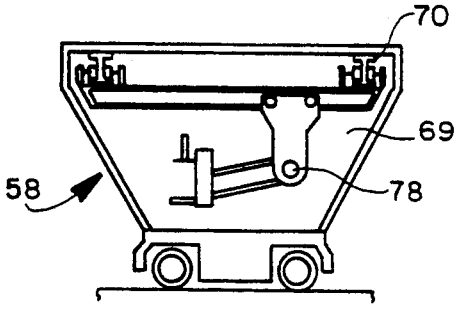
FIG. 3 is a side elevational view of a transporter carrying a robot.
Figure 4:
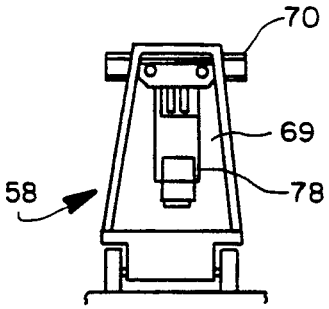
FIG. 4 is an end elevational view of a transporter carrying a robot.

Referring to FIGS. 3 and 4, a portable gantry robot 78 is supported by the rails 70. The body of the robot 78 is contained within the central space 69 of the transporter 58. The robot 78 is shown carried within the transporter 58 for illustrative purposes. The mechanical design of the preferred form of the robot 78 is lightweight and facilitated by vision techniques.

The transporter 58 can be non-powered or self-propelled. If it is non-powered, it is moved by a tractor or other form of industrial truck.

The rails 70 of the transporter 58 lock onto either end of the overhead rails 50 and 54 or lock onto rails adjoining the displaceable section 52 of the rail system 50.

When the transfer section is determined by sensors (not shown) to be in the proper position for alignment, the rail section 70 on the transporter 58 automatically locks into the permanent rail structure 50 or 54.

The locking mechanisms may be pneumatic, hydraulic, or electro-mechanical. If the transporter is self-powered it could have a hydraulic pump driven from the same power source as for locomotion. If non-powered, a pump or compressor for hydraulic or pneumatic power could be driven by an electric motor temporarily connected to a nearby electric power source. An economical alternative would be a pneumatic actuating mechanism deriving its power from an available compressed air supply in the area, via a hose with quick connect/disconnect fittings. Transportation of a non-powered transporter could be via an automatic guided vehicle, a manned fork truck, in-floor tow lines, or a combination of all of these.

In general, the robot 78 interfaces with the transporter 58 which permits easy removal from a given rail system for transport to another rail system or maintenance area within a given manufacturing facility.

There are three methods of attaching the portable robotic units to the overhead rails as illustrated in FIGS. 5–35.

FIGS. 5 through 11 illustrate one method wherein a robotic unit 80 can be picked up or delivered from one end of the rail system 82 having double or parallel tracks of rails. In the printing plant embodiment, delivery and pick up of robots in the bindery 46 is accomplished in this way at each individual rail system 54. In the press room 44, delivery and pick up of robots at each end of the press room rail system 50 could also be accomplished by these means.

Figure 5:
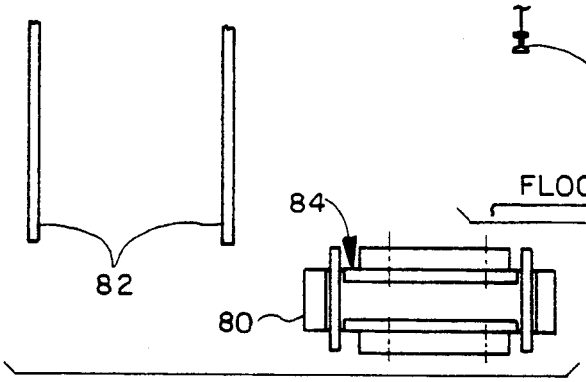
FIG. 5 is a plan view of a transporter carrying a robot approaching an end of an overhead rail section.
Figure 6:
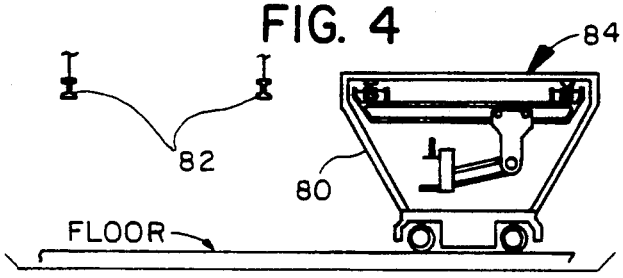
FIG. 6 is a front elevation of FIG. 5.

Referring to FIGS. 5 and 6, a transporter 84 with a robot 80 aboard approaches an end of the rail system 82.

Figure 7:
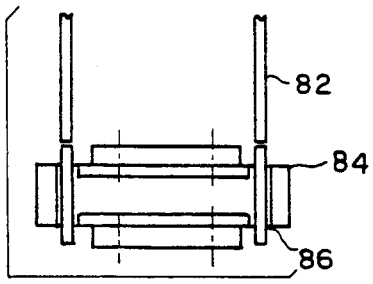
FIG. 7 is a plan elevation of the transporter carrying a robot and aligned with one end of the overhead rail system of FIG. 5.
Figure 8:
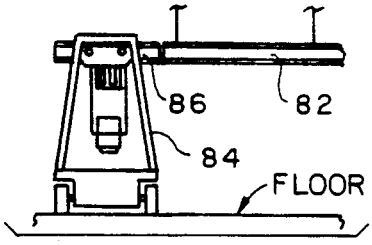
FIG. 8 is a side view of FIG. 7.
Figure 9:
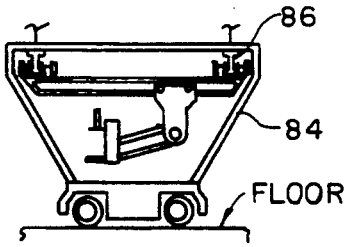
FIG. 9 is a front elevational view of FIG. 7.

Referring to FIGS. 7–9, guides and sensors (not shown) indicate the position of a transfer rail section 86 on the transporter 84 relative the rail system 82 in order to deliver the robot. When the rails of the transfer rail section 86 are in alignment with the rails of the overhead rail system 82, the transfer rail section 86 is locked to the end of the rail system 82.

Figure 10:
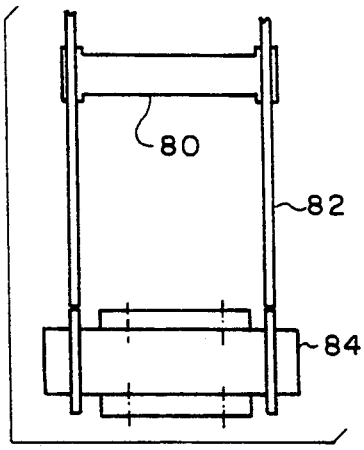
FIG. 10 is a plan view of the transporter aligned at one end of the overhead rail system of FIG. 5 and the robot moved onto the rail system.
Figure 11:
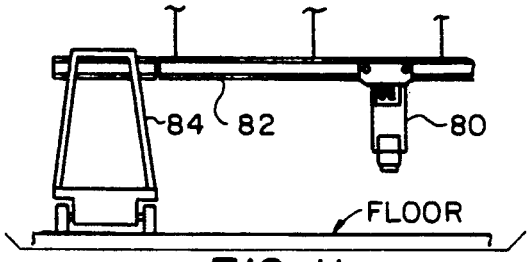
FIG. 11 is a side elevational view of FIG. 10.

Referring to FIGS. 10 and 11 the gantry robot 80 has been transferred from the transporter 84 to the rail system 82. The rail system 82 may be electrified for powered movement of the robotic unit 80. After the transporter 84 is unlocked from the rail system 82, the transporter 84 is free to pursue its next transport assignment.

Each manufacturer of overhead rail systems has a proprietary design for accomplishing locking and unlocking. The choice of equipment vendor determines the locking mechanism design which is well within the skill of those in the art.

The reverse of the operations illustrated in FIGS. 5 through 11 would be used to pick up a robotic unit from a rail system 82. The transfer rail section 86 of a transporter 84 would be locked on one end of a rail system 82. The robot 80 would then be moved onto the transfer rail section 86. The transfer section 86 would then be unlocked from the rail system 82 and the robot 80 would be free to be moved to another location such as other rail systems, storage or maintenance.

The two other methods illustrated in the remaining Figures are for inserting and removing a robot using displaceable rail sections. In FIGS. 12 through 23, a section of rails is horizontally displaced to the side of the rail system, while in FIGS. 24 through 35, the rails are vertically displaced upward from the permanent rail system. Space limitations and cost considerations would dictate which of these two alternatives for displaceable sections would be viable for a given application. As is understood by those skilled in the art, other configurations are also possible to displace a section of rails.

Figure 12:
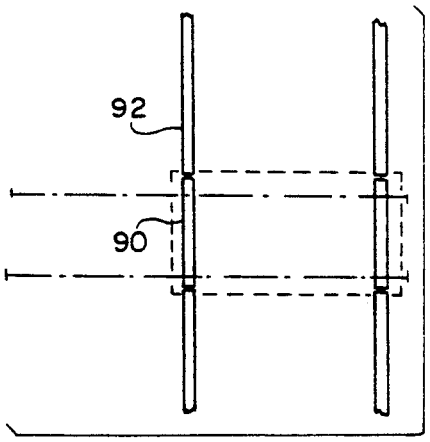
FIG. 12 is a plan view of a displaceable section capable of being displaced horizontally to one side of the rail system.
Figure 13:
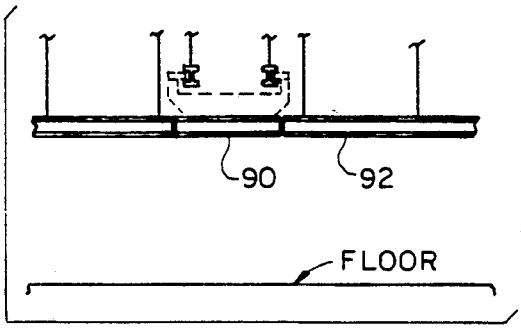
FIG. 13 is a side elevation of FIG. 12.
Figure 14:
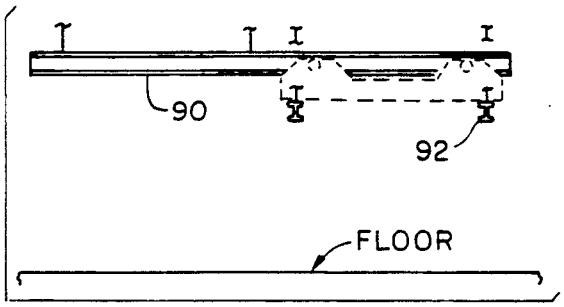
FIG. 14 is a front elevation of FIG. 12.

Referring to FIGS. 12 through 14, a displaceable rail section 90 has been inserted into a fixed overhead rail system 92. In this embodiment, the rail section 90 is displaceable horizontally to one side of the overhead rails 92.

Figure 15:
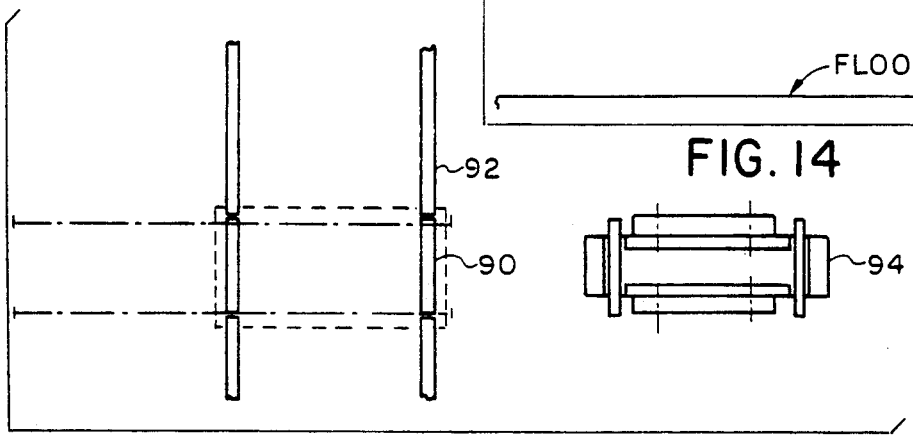
FIG. 15 is a plan view of a transporter carrying a robot approaching the displaceable sections of FIG. 12.
Figure 16:
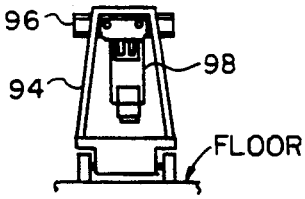
FIG. 16 is a side elevational view of FIG. 15.
Figure 17:
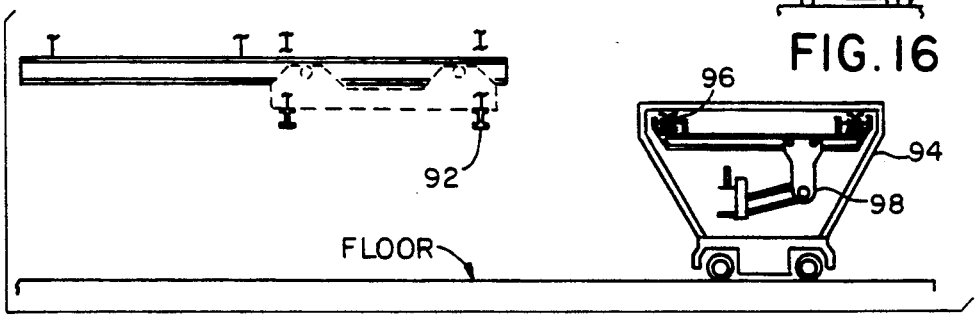
FIG. 17 is a front elevation of FIG. 15.

Referring to FIGS. 15 through 17, a transporter 94 having a transfer rail section 96, carrying a robotic unit 98 approaches the displaceable rail section 90 from a perpendicular direction for the purpose of delivering the robotic unit 98.

Figure 18:
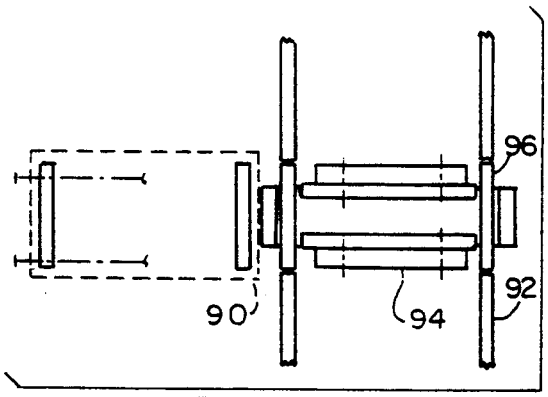
FIG. 18 is a plan view of the displaceable section of FIG. 15 that has been displaced horizontally and the transporter is aligned with the rail system.
Figure 19:
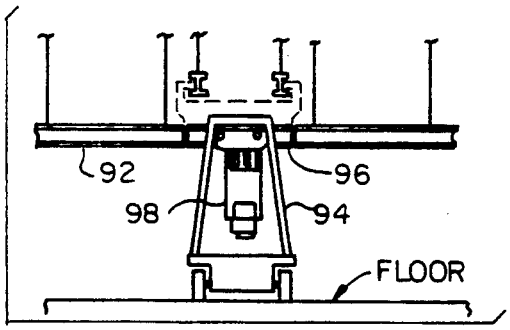
FIG. 19 is a side elevation of FIG. 18.
Figure 20:
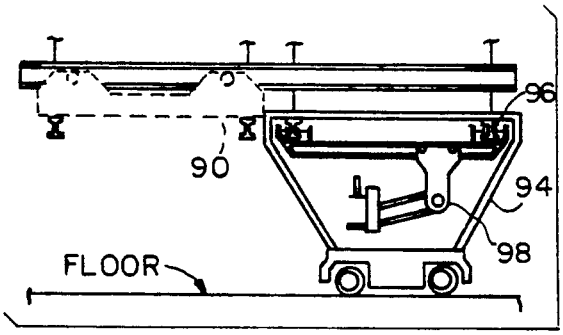
FIG. 20 is a front elevation of FIG. 18.

Referring to FIGS. 18 through 20, guides and sensors (not shown) indicate that the transporter 94 is in proper alignment with the displaceable rail section 90. The transporter 94 horizontally displaces the section of rails 90 replacing it with its own transfer rail section 96 supporting a robot 98 thereon. Sensors (not shown) indicate proper alignment of the transfer rail section 96 with the fixed overhead rails 92. The transfer rail section 96 is automatically locked into place in the overhead rail system 92.

Figure 21:
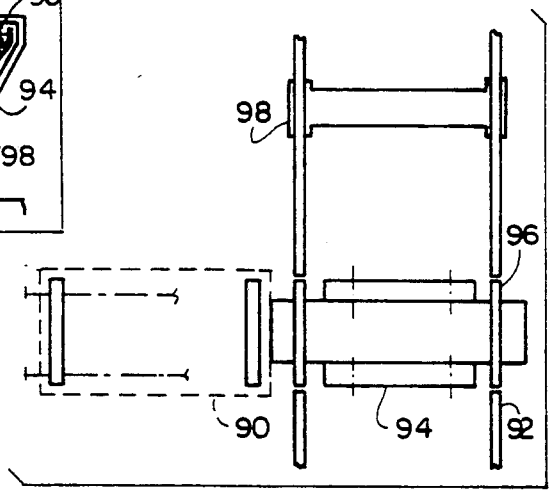
FIG. 21 is a plan view of the robot of FIG. 18 moved onto the rail system, and the now empty transporter.
Figure 22:
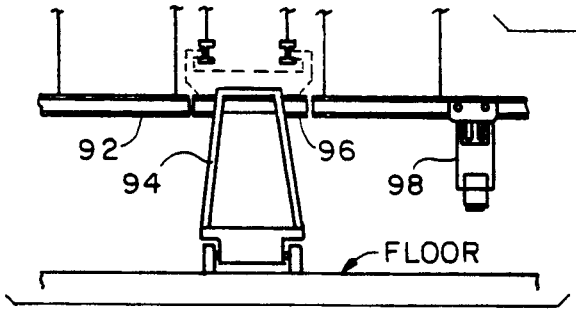
FIG. 22 is a side elevation of FIG. 21.
Figure 23:
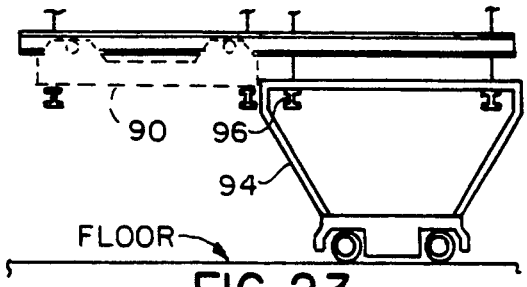
FIG. 23 is a front elevation of FIG. 21.

Referring to FIGS. 21 through 23, after the transfer of the robotic unit 98 from the transfer rail section 96 to the overhead rail system 92, the robotic unit 98 is moved to a location along the overhead rail system 92 to a work station, for palletizing or depalletizing. Once the robot's transfer is complete, the transfer rail section 96 automatically unlocks, the transporter 94 moves away from the overhead rail system 92 and the displaceable rail section 90 simultaneously relocates to its normal position in the overhead rail system 92.

When a robot is being removed from an overhead rail system 92, the reverse procedure is conducted. The displaceable rail section 90 is displaced, the transfer rail section 96 aligns with the fixed rail system 92 and the robot 98 is moved onto the transfer rail section 96. Then, the transfer rail section 96 unlocks from the fixed rail system 92 and the displaceable rail section 90 is simultaneously moved back into place.

FIGS. 24 through 34 illustrate a third method wherein a displaceable rail section 100 of a fixed overhead rail system 102 is displaced vertically upward by a transporter 104. The transporter 104 includes an integral hydraulic lifting mechanism 106. In this embodiment, the displaceable rail section 100 does not include a separate power source for movement.

Figure 24:
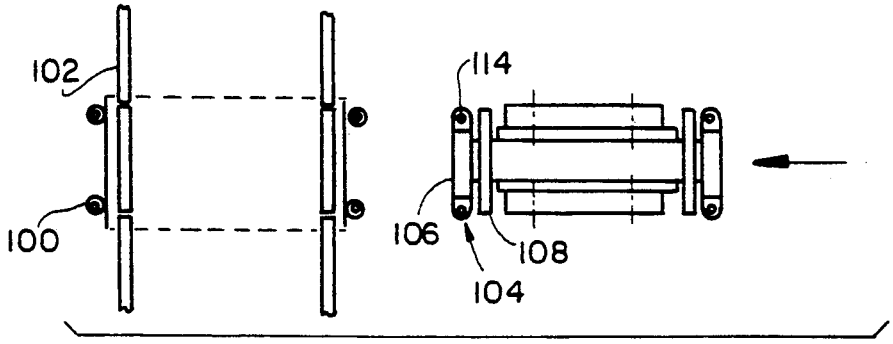
FIG. 24 is a plan view of a transporter carrying a robot approaching a displaceable rail section that is vertically displaceable above the rail system.
Figure 25:
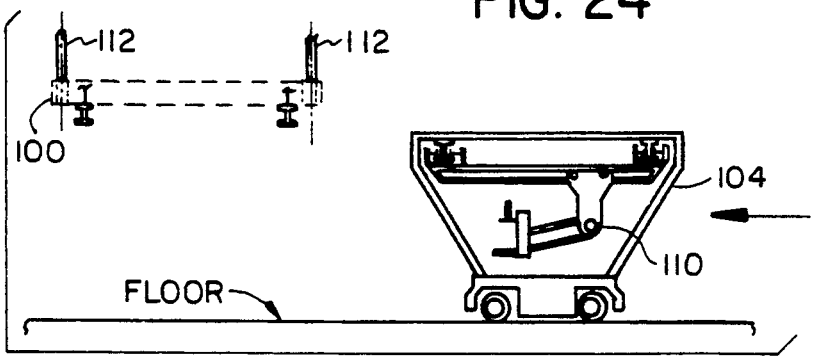
FIG. 25 is a front elevation of FIG. 24.
Figure 26:
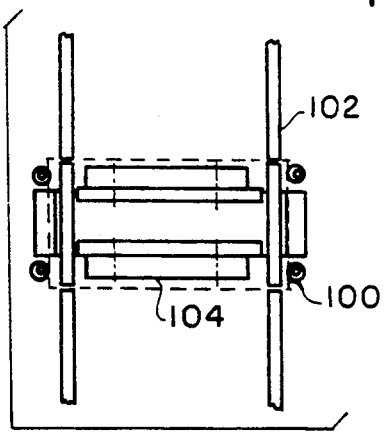
FIG. 26 is a plan view of the transporter aligned with the rail system at the displaceable rail section of FIG. 24.
Figure 27:
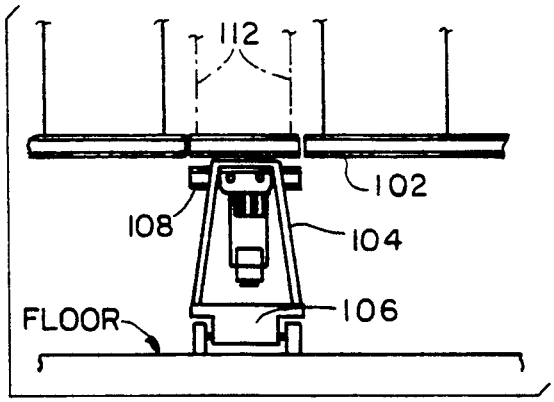
FIG. 27 is a side elevation of FIG. 26.
Figure 28:
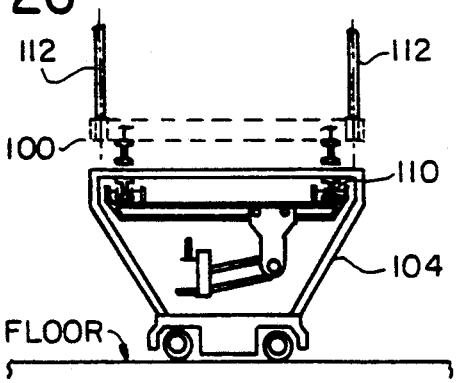
FIG. 28 is a front elevation of FIG. 26.
Figure 29:
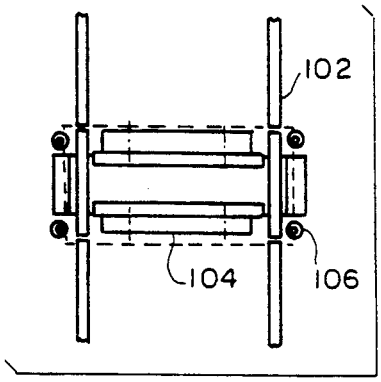
FIG. 29 is a plan view of the rails of FIG. 26 that have been displaced and the transporter moved into place.

Referring to FIGS. 24 and 25, the transporter 104 contains an integral transfer rail section 108 with a robotic unit 110 supported thereon, and it approaches the overhead rail system 102 from a perpendicular direction for the purpose of delivering the robotic unit 110. The displaceable rail section 100 is suspended on four vertical guide shafts 112 and shaft targets 114 attached to the transporter 104 utilize the vertical guides 112 to assure alignment of the transporter 104 below the displaceable rail section 100 as the displaceable rail section 100 is lifted by the transporter 104.

Referring to FIGS. 26 through 29, the transporter 104 with the aid of sensors (not shown) has been located directly beneath the displaceable rail section 100.

Figure 30:
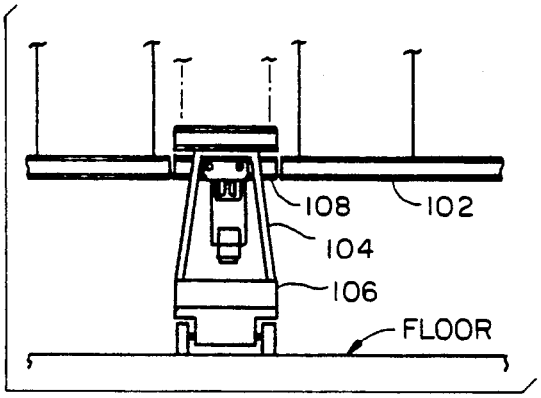
FIG. 30 is a side elevation of FIG. 29.
Figure 31:
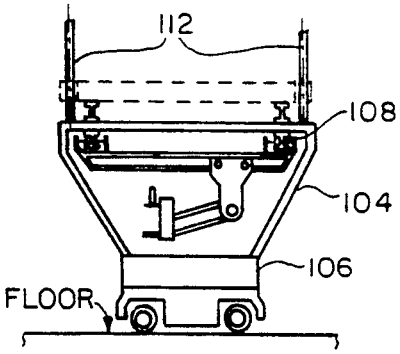
FIG. 31 is a front elevation of FIG. 29.
Figure 32:
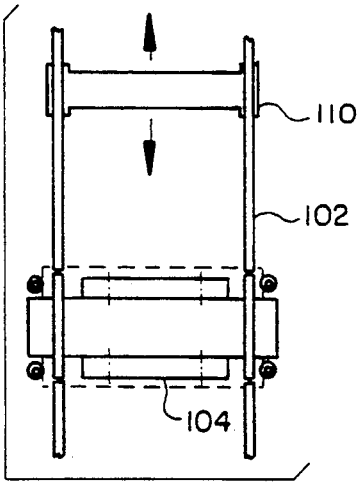
FIG. 32 is a plan view of the robot that has been moved from the transporter of FIG. 29.

Referring to FIGS. 30 through 32, the transporter 104 has been accurately located beneath the displaceable rail section 100 and the integral hydraulic lifting unit 106 on the transporter 104 is activated, lifting the displaceable rail section 100 vertically upward until alignment of the transfer rail section 108 and the fixed overhead rail system 102 occurs. Sensors then automatically stop upper travel of the lifting mechanism 106 and lock the transfer rail section 108 in place. The robotic unit 110 is then transferred to the fixed overhead rail system 102.

Figure 33:
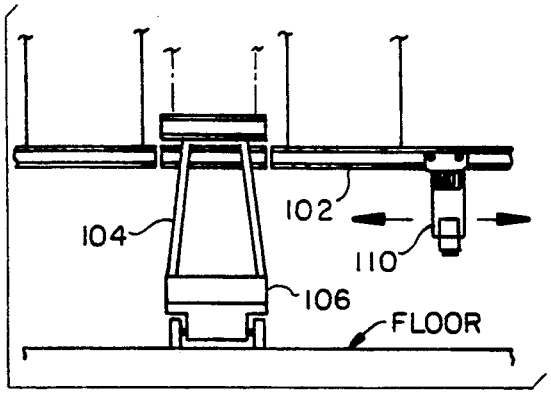
FIG. 33 is a side elevation of FIG. 32.
Figure 34:
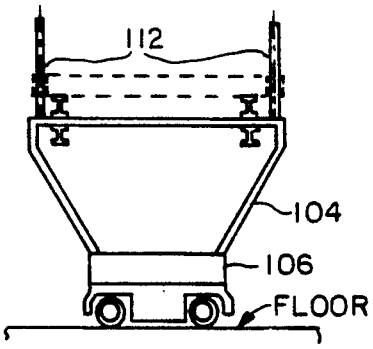
FIG. 34 is a front elevation of FIG. 32.

Referring to FIGS. 32 through 34, the transporter 104 has been unloaded with its hydraulic lift mechanism 106 still in the upward position. Following transfer of the robot 110, the lift 106 is lowered, simultaneously lowering the displaceable rail section 100 to its normal position in the overhead rail system 102.

The reverse operation is used to remove a robotic unit 110. An empty robotic transport 104 aligns and displaces a rail section 100 and the robot 110 is moved onto the transfer rail section 108 of the transporter 104 after which the transfer rail section 108 is unlocked and the lift 106 is lowered. Then, the transporter 104 is free to move the robot 110 to another location and the displaceable rail section 100 is back in alignment with the remainder of the rail system 102.

There are many unique advantages in having an automated printing plant as described above. The system maximizes the utilization of the robotic units by using transporters to easily relocate gantry robotic units to newly assigned work stations.

Maximum utilization of the entire complement of portable robotic palletizer/depalletizers in a given plant is achieved. A minimum total requirement of units is incorporated. Units idle because of a lack of scheduled work for a given cost center, significant makereadies or other major equipment down times are easily relocated. Only the amount of equipment required for a given job on a given press/bindery line is assigned to that cost center.

The system also provides flexibility between automated and manual processes. Floor space in front of press deliveries, the bindery, and primary storage areas are left open to allow manual operations to intercede when and where required. Manual unit load removal and delivery via walking or manually operated industrial fork truck is possible whether palletizing or depalletizing is automatic or manual. Transport access for many other commodities required around press bindery layouts is thus simplified.

Overall, the high utilization of robotic units achieved through this system is paramount to reducing the cost of total plant automation to the point of economic feasibility.

The foregoing disclosure and specific embodiments are illustrative of the broad inventive concepts comprehended by the invention as defined by the appended claims, and is in no way meant to be limiting thereto.

I claim:

1. A portable gantry robot system comprising:

a plurality of overhead rail systems for suspending a gantry robot, each of said rail systems comprising at least one rail, wherein all of said rail systems have rails of the same general cross section;

at least one portable gantry robot suspendable by any one of said overhead rail systems;

means for transporting said portable robot horizontally between said overhead rail systems;

a displaceable section of at least one of said overhead rail systems, means for displacing said displaceable section for insertion of said portable gantry robot onto said overhead rail system adjacent said displaced displaceable section.

2. The portable gantry robot system of claim 1 further comprising work stations along said rail systems and means for propelling said gantry robots along said rail systems to said work stations.

3. The portable gantry robot system of claim 1 wherein said transporting means includes a transporter for transporting said robot, said transporter comprising a transfer rail section of the same general cross section as said rails of said rail system and the same length as said displaceable section, and said robot being suspended by said transfer rail section during transportation of said robot on said transporter.

4. The portable gantry robot system of claim 3 further comprising:

said displacing means mounted to said transporting means, said displacing means horizontally moving said displaceable section tangentially to and to one side of said one of said rail systems;

means for locking said transfer rail section to said one rail system adjacent said displaceable section when said displaceable section has been moved horizontally to one side; and means for moving said robot between said one rail system and said transfer raid section.

5. The portable gantry robot system of claim 3 further comprising:

said displacing means mounted to said transporting means, said displacing means vertically moving said displaceable section above said one of said rail systems;

means for locking said transfer rail section to said one rail system adjacent said displaceable section when said displaceable section has been moved vertically above said one rail system; and means for moving said robot between said one rail system and said transfer rail section.

6. The portable gantry robot system of claim 3 further comprising:

means for aligning said transfer rail section with at least one end of at least one of said rail system;

means for locking at least one end of said transfer rail section onto said end of said rail system; and means for moving a robot between said rail system and said transfer rail section.

7. An automated industrial plant comprising:

a plurality of work stations;

at least one rail suspended above said work stations having at least one displaceable rail section;

at least one portable gantry robot capable of being suspended by said rail;

means for moving said robot along said rail;

means for transporting said robot horizontally to and from said displaceable rail section, said transporting means including a transfer rail section of the same length and size as said displaceable rail section, said robot being removably suspended from said transfer rail section;

means for displacing and replacing said displaceble rail section;

means for aligning said transfer rail section with said rail at a location adjacent said displaceable rail section; and means for locking and unlocking said transfer rail section onto said rail at said location adjacent said displaceable rail section.

8. The automated industrial plant as in claim 7 further comprising means on said transporting means for aligning said transfer rail section with at least one end of said rail.

9. The automated industrial plant as in claim 7 wherein said displaceable rail section is movable in a direction tangential to and to the side of said rail.

10. The automated industrial plant as in claim 7 wherein said displaceable rail section is movable to a point above said rail.

11. The automated industrial plant as in claim 7 wherein said transporting means comprises a transporter, said transporter comprising:

a base;

means for moving said transporter; and a frame extending upwards from said base for suspending the robot above the base;

said transfer rail section being mounted on said frame for suspending said portable robot.

12. A transporter for transporting a portable robot between said rail systems having a cross-sectional size, said transporter comprising:

a base;

a frame extending upwards from said base for suspending a portable robot above the base;

means for moving said transporter in a horizontal plane; and transport rail means mounted on said frame for suspending said robot while said robot is being transported on said transporter, said transport rail means being substantially identical in cross-sectional size to said rail systems.

13. The transporter of claim 12 wherein at least one of said rail systems contains at least one displaceable section, said transport rail means being substantially identical in length to said displaceable section, and said transporter further comprising means for displacing said displaceable section.

14. An automated printing plant having a press room and a bindery area, said plant comprising:

at least one portable robot;

a plurality of press delivery stations in the press room positioned in a row;

at least one press rail system supported above said delivery stations, said rail system having a cross-sectional size;

means on one of said robot and said rail system for suspending said robot from said press rail system;

means for moving said robot along said press rail system;

a transporter having a transfer rail section affixed thereto for suspending said robot therefrom, said transfer rail section being the same cross-sectional size as said press rail system;

means for moving said robot between said transfer rail section and said press rail system;

a plurality of binding lines in the bindery area;

a bindery rail system above each of said binding lines identical in cross-sectional size to said press rail system;

means on one of said robot and said binding rail system for suspending said robot from said bindery rail system;

means on said press rail system and said bindery rail system for receiving said transfer rail section for transfer of said robot between said rail systems and said transporter;

means on the transporter for aligning said transfer rail section with said receiving means;

means for locking and unlocking said transfer rail section onto said receiving means;

means for moving said robot in a suspended position in a horizontal plane between said transfer rail section and each of said bindery rail systems; and means for moving said robot along said bindery rail system.

15. The automated printing plant of claim 14 wherein said receiving means comprises at least one displaceable rail section, said transfer rail section being the same length as said displaceable rail section, said plant further comprising:

means for displacing and replacing said displaceable rail section relative to said rail system; and means for locking and unlocking said transfer rail section onto said rail systems at a former location of said displaceable rail section when said displaceable rail section has been displaced from said rail systems.

16. A method of transferring a robot between locations on a overhead rail system, said method comprising the steps of:

(1) providing a displaceable rail section in said rail system;

(2) providing a transporter having a transfer rail section thereon for suspending a robot;

(3) transporting the robot on the transporter in a suspended position to said displaceable rail section;

(4) displacing said displaceable rail section;

(5) aligning and locking said transfer rail section suspending said robot with said rail system at the former location of said displaceable rail section;

(6) moving said robot off of said transfer rail section and onto a suspended position on said rail system;

(7) unlocking and moving said transporter from said location of said displaceable rail section; and (8) moving said displaceable rail section back into alignment with said rail system.

17. The method of claim 16 further comprising the steps of:

(1) aligning an empty transporter adjacent said displaceable rail section;

(2) displacing said displaceable rail section;

(3) aligning and locking a transfer rail section of said empty transporter with said rail system;

(4) moving said robot onto said transfer rail section from said rail system;

(5) unlocking and moving said transporter with said transfer rail section while said transfer rail section is suspending said robot; and (6) moving said displaceable rail section back into alignment with said rail system.

18. A method of automating an industrial plant, comprising the steps of:

(1) providing portable robots capable of performing tasks;

(2) organizing work areas for said robot in areas in the plant having said tasks performed by said robots;

(3) arranging a plurality of said work area into rows;

(4) suspending a plurality of substantially identical rail systems over said work areas capable of suspending said robots while said robots are performing said tasks;

(5) providing at least one displaceable rail section in at least one of said rail systems;

(6) horizontally transporting said portable robots on a transporter between non-contiguous rail systems and a displaceable rail section within said one of said rail systems, said transporter having a transfer rail section substantially identical in size and form to said displaceable rail section from which the robot is suspended; and (7) moving said robot between said transfer rail section and said work area:

by displacing said displaceable rail section; and locking into place said transfer rail section at the location where said displaceable rail section was displaced.

* * * * *